US006152861A

United States Patent [19]

Chen

[11] Patent Number: 6,152,861

[45] Date of Patent: Nov. 28, 2000

[54] DETACHABLE MAIN FRAME FOR EXERCISE MACHINE

[76] Inventor: Ping Chen, No. 29, Nanmei St., Nantun Li, Nantun Dist., Taichung, Taiwan

[21] Appl. No.: 09/245,072

[22] Filed: Feb. 5, 1999

[51] Int. Cl.[7] ..... A63B 22/06

[52] U.S. Cl. ..... 482/57; 482/58; 482/59

[58] Field of Search ..... 482/910, 908, 482/148, 57, 58, 59, 60, 62, 63, 64, 65

[56] References Cited

U.S. PATENT DOCUMENTS 4,334,676 6/1982 Schonenberger ..... 272/69

5,062,633 11/1991 Engel et al. ..... 272/132

5,443,434 8/1995 Buchanan et al. ..... 482/59

*Primary Examiner*—Jerome W. Donnelly

*Assistant Examiner*—Tam Nguyen

*Attorney, Agent, or Firm*—Rosenberg, Klein & Lee

[57] ABSTRACT

A detachable main frame for an exercise machine includes a casing containing a support column of the exercise machine therein and having a closed side, an open side, and a cover removably attached to the open side of the casing and having a configuration conforming to that of the open side of the casing. In such a manner, the cover can be removed from the casing so as to expose the open side of the casing, thereby allowing a tool to be inserted into the casing of the main frame to facilitate maintenance inside the casing.

1 Claim, 5 Drawing Sheets

DETACHABLE MAIN FRAME FOR EXERCISE MACHINE

CROSS-REFERENCES TO RELATED APPLICATIONS

Not Applicable.

BACKGROUND OF THE INVENTION

1. Field of the Invention

The present invention relates to a detachable main frame, and more particularly to a detachable main frame for an exercise machine such as an exercise bicycle.

2. Description of the Related Art

A conventional exercise machine such as an exercise bicycle in accordance with the prior art usually comprises a main frame, a front support column having a lower portion received in the main frame and an upper portion extending through the main frame to support an article such as a handlebar, and a rear support column having a lower portion received in the main frame and an upper portion extending through the main frame to support an article such as a seat. In such a manner, the main frame with a fixed structure cannot be easily assembled or dismantled such that a tool cannot be inserted into the main frame, thereby causing inconvenience for maintenance of the inside of the main frame. The present invention has arisen to mitigate and/or obviate the disadvantage of the conventional exercise machine.

BRIEF SUMMARY OF THE INVENTION

In accordance with one aspect of the present invention, there is provided a detachable main frame in combination with an exercise machine, the exercise machine including at least one support column, and the main frame comprising a casing containing the support column therein and having a closed side and an open side, and a cover removably attached to the open side of the casing and having a configuration conforming to that of the open side of the casing.

The casing includes two side walls each containing a locking hole transversely defined therein, and the cover includes a top plate mounted on the casing and two flexible snappers each extending from the top plate of the cover to be received in the casing, and each abutting one of the two corresponding side walls of the casing, each of the two flexible snappers including a locking hook releasably received in the locking hole of one of the two corresponding side walls of the casing.

The casing includes a top wall, a locking stud extending upward from the top wall and containing a threaded locking bore defined therein, the top plate of the cover abuts the locking stud of the casing and contains a retaining hole therein aligning with the locking bore of the locking stud, and the detachable main frame further comprises a locking bolt extending through the retaining hole and screwed into the locking bore. The top wall of the casing contains an opening therein connecting to the casing for passage of each of the two flexible snappers.

In accordance with another aspect of the present invention, the cover is arranged in an inclined manner relative to the casing, and the top plate of the cover is arranged in an inclined manner relative to the top wall of the casing.

Further benefits and advantages of the present invention will become apparent after a careful reading of the detailed description with appropriate reference to the accompanying drawings.

DETAILED DESCRIPTION OF THE INVENTION

Figure 1:
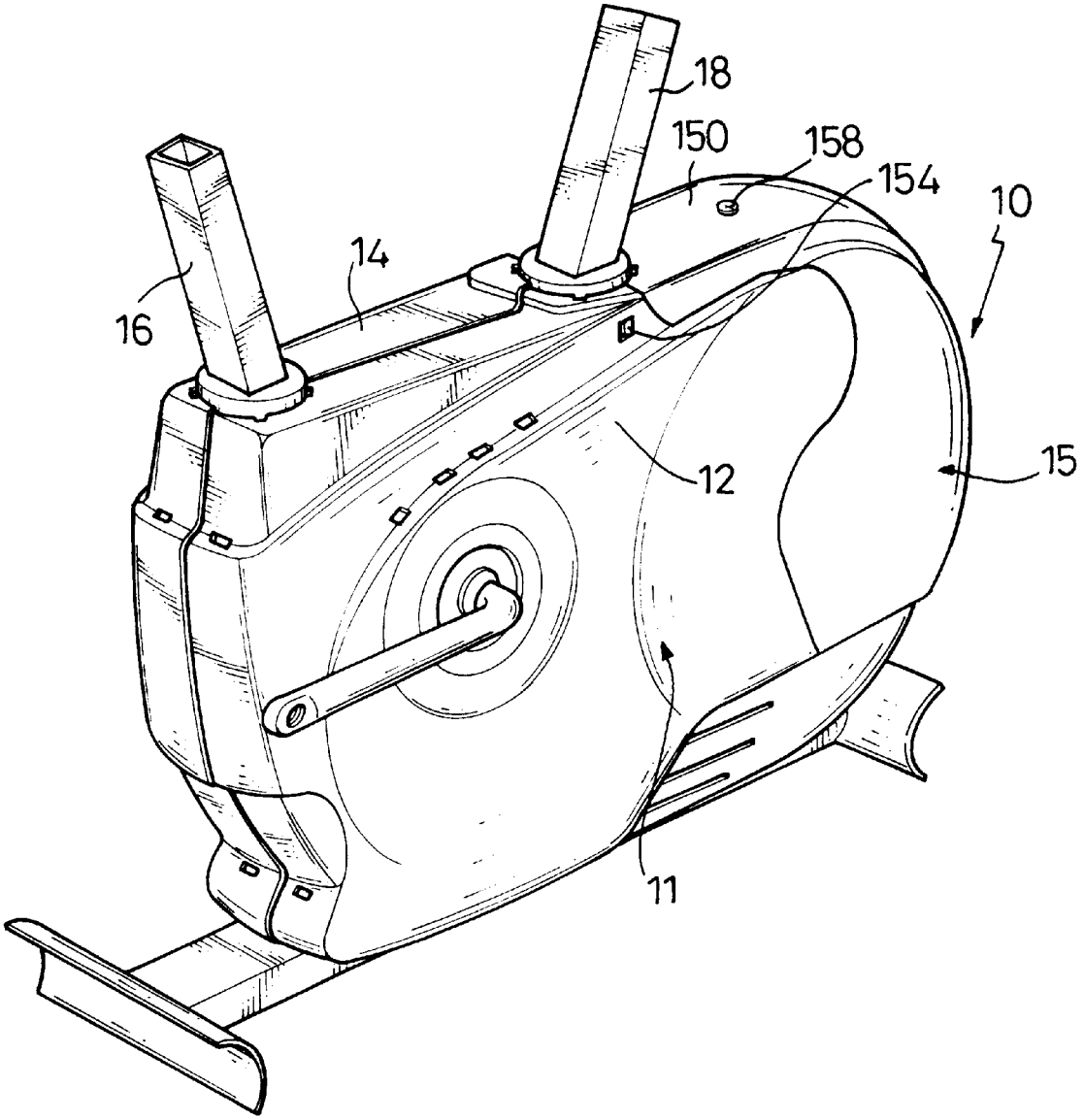
FIG. 1 is a perspective view of an exercise machine in accordance with a first embodiment of the present invention.
Figure 2:
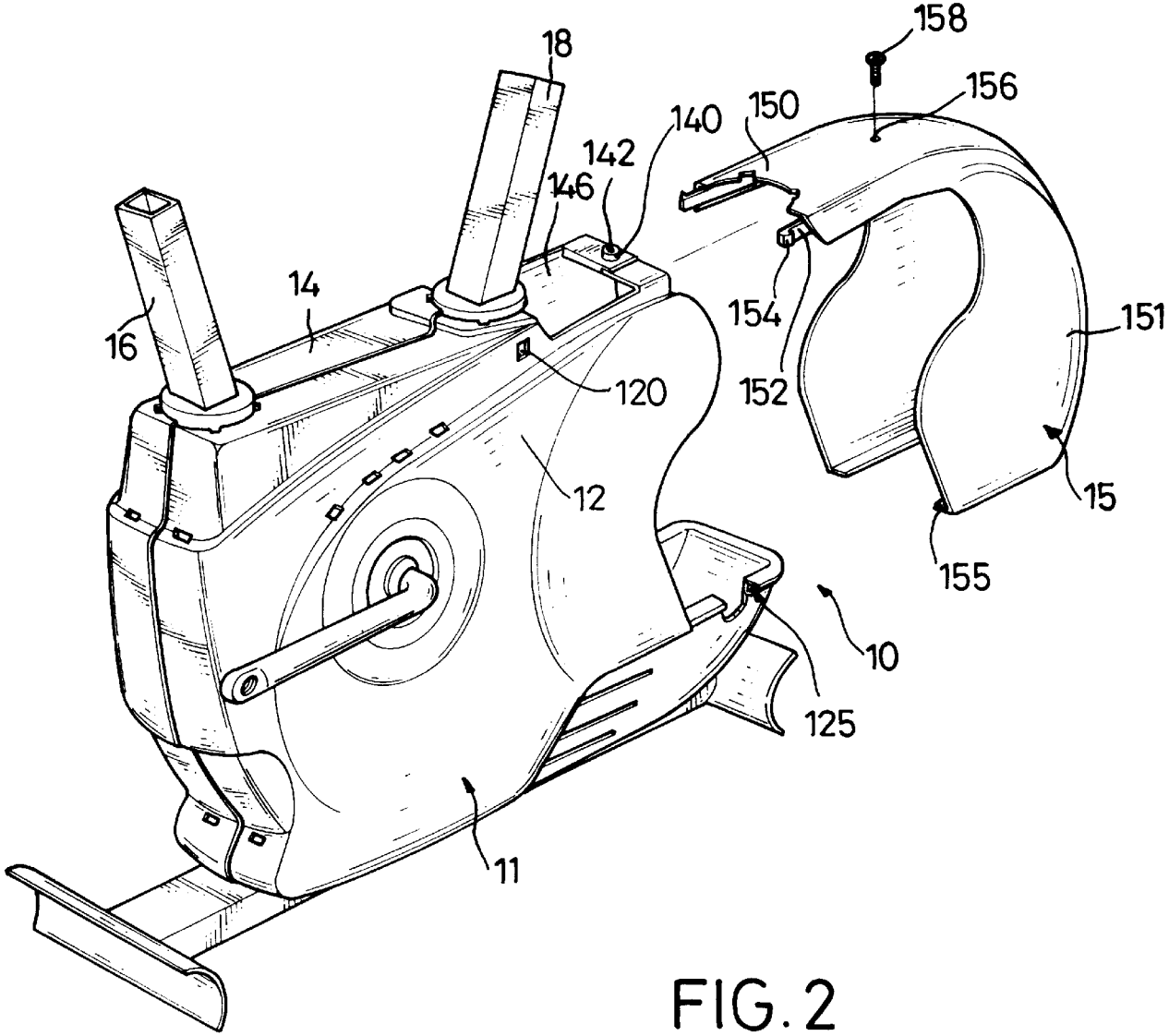
FIG. 2 is an exploded perspective view of the exercise machine as shown in FIG. 1.
Figure 3:
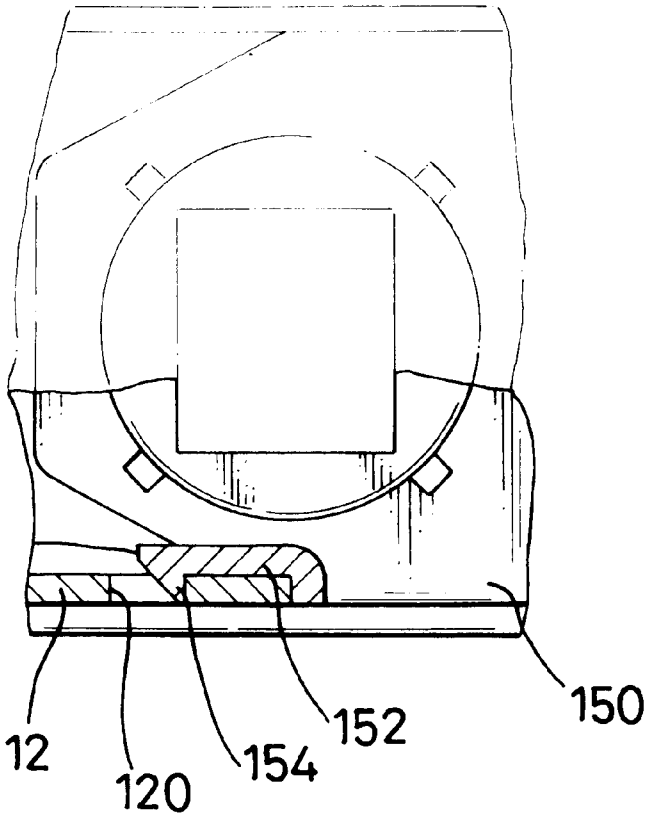
FIG. 3 is a top plan partially cut-away cross-sectional view of the exercise machine as shown in FIG. 1.

Referring to the drawings and initially to FIGS. 1–3, an exercise machine such as an exercise bicycle in accordance with a first embodiment of the present invention comprises a detachable main frame (10), a front support column (16) including a lower portion received in the main frame (10), and an upper portion extending through the main frame (10) to support an article such as a handlebar, and a rear support column (18) including a lower portion received in the main frame (10) and an upper portion extending through the main frame (10) to support an article such as a seat.

The detachable main frame (10) comprises a casing (11) containing the front support column (16) and the rear support column (18) therein and including a closed side and an open side, and a cover (15) removably attached to the open side of the casing (11). The configuration of the cover is designed to conform to that of the open side of the casing (11).

The casing (11) includes two side walls (12) each containing a locking hole (120) transversely defined in the upper portion thereof, and each including a guide track (125) formed on the lower portion thereof. The cover (15) includes a top plate (150) mounted on the casing (11), and two side plates (151) each formed with a flange (155) extending inward from the bottom thereof and slidably received in the guide track (125) of one of the two side walls (12) of the casing (11).

Two flexible snappers (152) each extend from the top plate (150) of the cover (15) to be received into the casing (11), and each abut one of the two corresponding side walls (12) of the casing (11). Each of the two flexible snappers (152) includes a locking hook (154) releasably received in the locking hole (120) of one of the two corresponding side walls (12) of the casing (11), thereby detachably securing the cover (15) to the casing (11).

The casing (11) further includes a top wall (14) containing an opening (146) therein connecting to the casing (11) for passage of each of the two flexible snappers (152) into the casing (11).

In operation, the cover (15) is moved from the position as shown in FIG. 2 to the position as shown in FIG. 1, so as to releasably insert the locking hook (154) of each of the two flexible snappers (152) into the locking hole (120) of the respective side wall (12) of the casing (11), thereby detachably securing the cover (15) to the casing (11) as shown in FIG. 1.

The user can use an article such as a bar (not shown) to press the locking hook (154) of each of the two flexible snappers (152) inward so as to detach the locking hook (154) from the respective locking hole (120), thereby releasing each of the flexible snappers (152) of the cover (15) from the respective side wall (12) of the casing (11) such that the cover (15) can be easily detached from the casing (11) as shown in FIG. 2 so as to expose the open side of the casing (11), thereby allowing a tool to be inserted into the casing (11) to facilitate maintenance inside the casing (11).

The casing (11) further includes a locking stud (140) extending upward from the top wall (14) thereof and containing a threaded locking bore (142) defined therein. The top plate (150) of the cover (15) abuts the locking stud (140) of the casing (12) and contains a retaining hole (156) therein aligning with the locking bore (142) of the locking stud (140). The detachable main frame (10) further comprises a locking bolt (158) in turn extending through the retaining hole (156) and screwed into the locking bore (142), thereby further securing the cover (15) to the casing (11).

Figure 4:
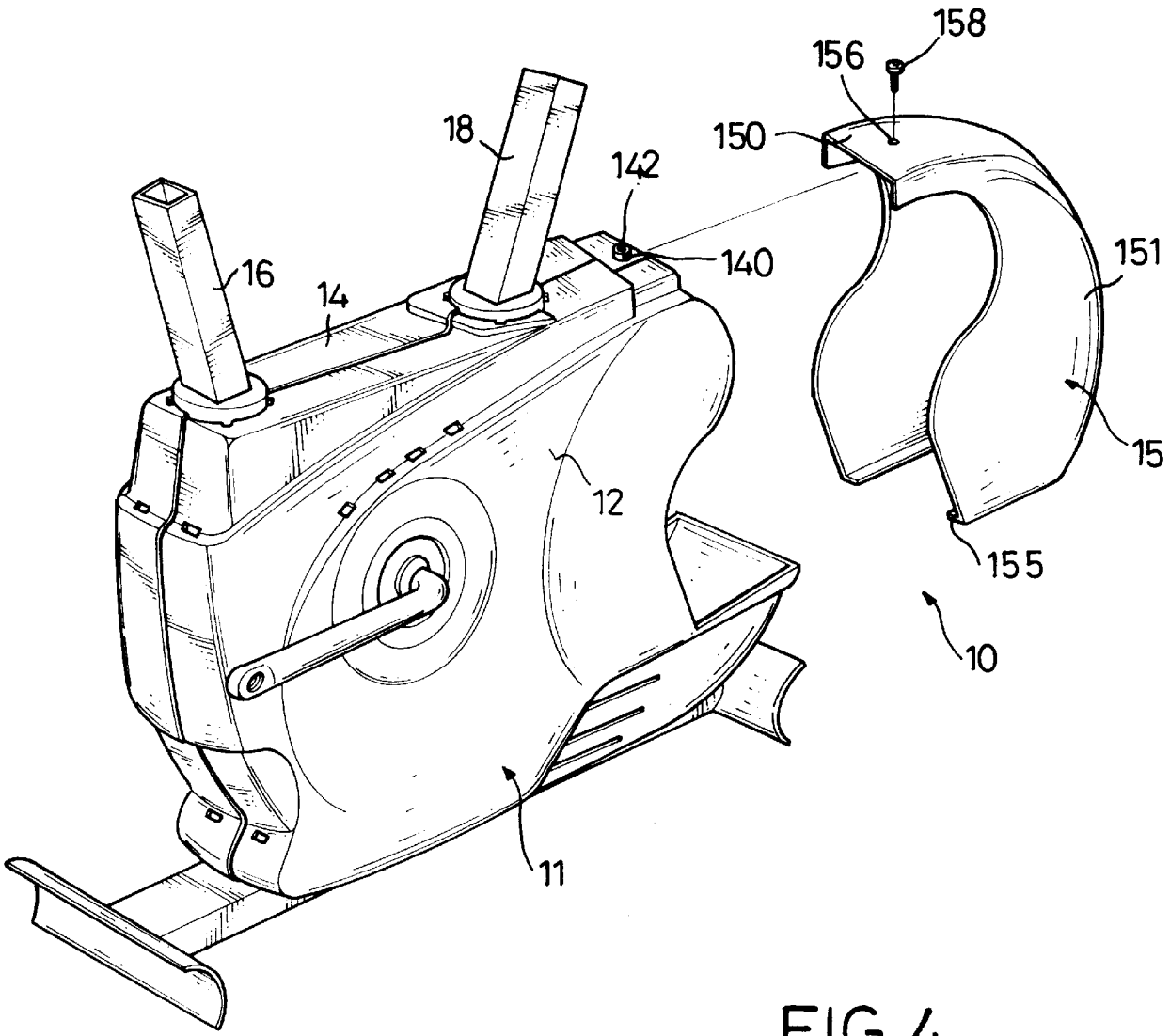
FIG. 4 is an exploded perspective view of the exercise machine in accordance with a second embodiment of the present invention.

Referring now to FIG. 4 with reference to FIG. 2, in accordance with a second embodiment of the present invention, the flexible snappers (152), the locking hooks (154), the opening (146), and the locking holes (120) are not included in the casing and have been removed from the drawing. In such a manner, the cover (15) is secured to the casing (11) by means of the locking bolt (158) only.

Figure 5:
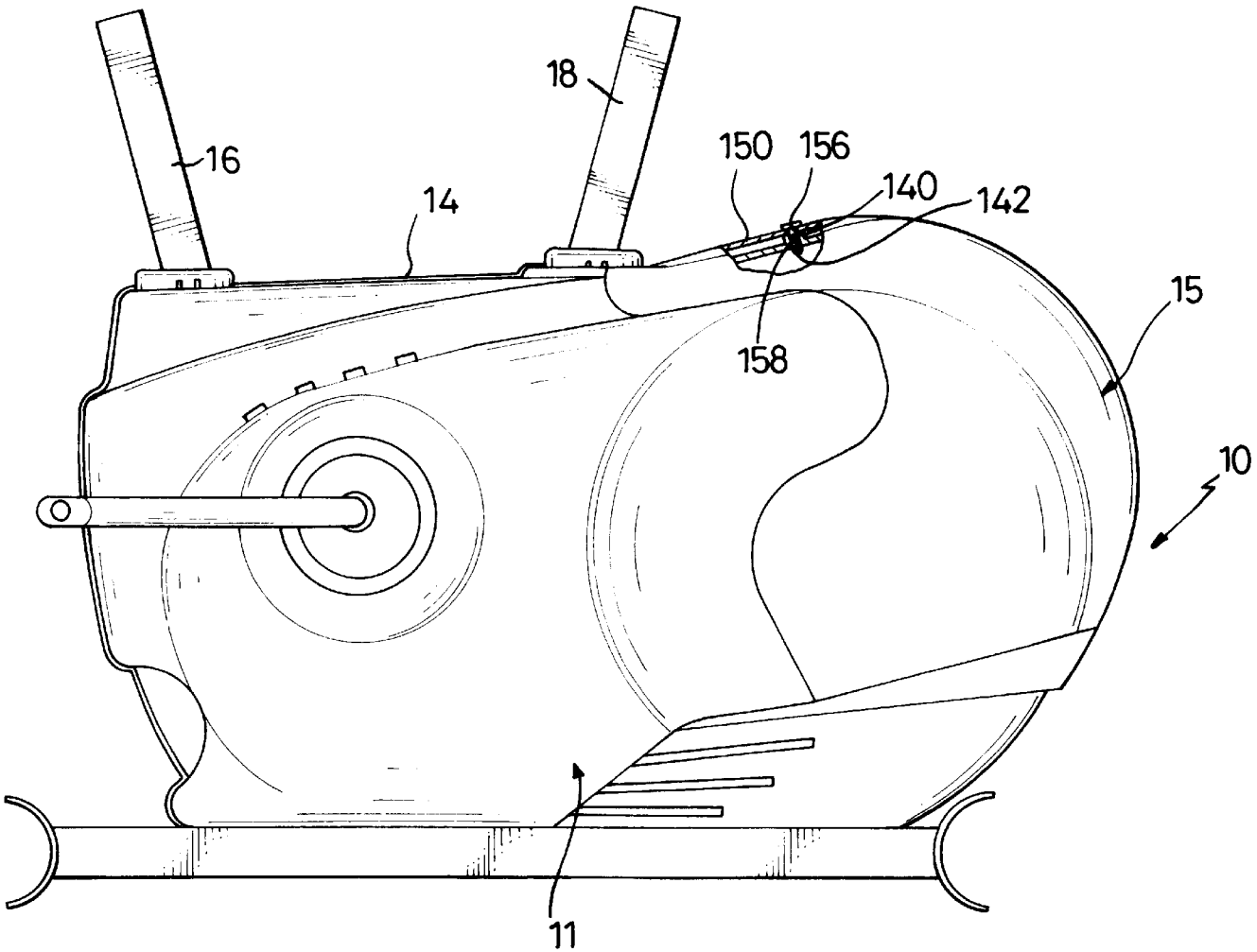
FIG. 5 is a side plan partially cross-sectional view of the exercise machine in accordance with a third embodiment of the present invention.

Referring now to FIG. 5 with reference to FIG. 1, in accordance with a third embodiment of the present invention, the cover (15) is oriented in an inclined manner relative to the casing (11), and the top plate (150) of the cover (15) is oriented in an inclined manner relative to the top wall (14) of the casing (11). Accordingly, the cover (15) can be easily secured to and detached from the casing (11) in an inclined manner.

It should be clear to those skilled in the art that further embodiments may be made without departing from the scope and spirit of the present invention.

What is claimed is:

1. A detachable main frame (10) in combination with an exercise machine, said exercise machine including at least one support column, said detachable main frame comprising:

a casing (11) containing said support column and having a closed side, an open side, an upper portion and a lower portion, said casing (11) including a top wall (14), a locking stud (140) extending upward from said top wall (14) and containing a threaded locking bore (142), said casing (11) includes two side walls (12), each of said side walls (12) having a locking hole (120) formed through said upper portion of said casing (11) and a guide track (125) formed on said lower portion of said casing (11);

a cover (15) removably attached to said open side of said casing (11) and having a configuration conforming to that of said open side of said casing (11) to form a closure therefor, said cover (15) including two side plates (151) each having a flange (155) extending inwardly from a bottom edge thereof and slidably engaging said guide track (125) of a corresponding one of said two side walls (12) of said casing (11), said cover (15) including a top plate (150) mounted on said casing (11), said top plate (150) extending over said locking stud (140) of said casing (11) and having a retaining hole (156) formed therethrough and aligned with said locking bore (142) of said locking stud (140), said cover (15) including two flexible snappers (152) each extending from said top plate (150) and having a locking hook (154) extending from a distal end thereof, each of said flexible snappers (152) extend into said casing (11) through an opening (146) for passage contiguous with a corresponding one of said side walls (12) of said casing (11), each of said locking hooks (154) being releasably engaged with a respective one of said locking holes (120); and a locking bolt (158) extending through said retaining hole (156) and screwed into said locking bore (142) of said locking stud (140).

* * * * *